US006719546B2

(12) United States Patent
Foerster

(10) Patent No.: US 6,719,546 B2
(45) Date of Patent: Apr. 13, 2004

(54) ARRANGEMENT FOR CONTROLLING THE FLOW OF A COOLANT FLUID IN A COMPRESSOR

(75) Inventor: Werner Foerster, Grub am Forst (DE)

(73) Assignee: Kaeser Kompressoren GmbH, Coburg (DE)

( * ) Notice: Subject to any disclaimer, the term of this patent is extended or adjusted under 35 U.S.C. 154(b) by 0 days.

(21) Appl. No.: 10/283,795

(22) Filed: Oct. 29, 2002

(65) Prior Publication Data

US 2003/0082065 A1 May 1, 2003

(30) Foreign Application Priority Data

Oct. 30, 2001 (DE) ..... 101 53 459

(51) Int. Cl.[7] ..... F04C 29/04

(52) U.S. Cl. ..... 418/84; 418/1; 418/85; 418/87; 418/97

(58) Field of Search ..... 418/1, 84, 85, 418/87, 97

(56) References Cited

U.S. PATENT DOCUMENTS

| | | | | |
|---|---|---|---|---|
| 4,289,461 A | | 9/1981 | van Oorschot et al. | 418/85 |
| 4,358,247 A | | 11/1982 | Suzuki et al. | 417/13 |
| 4,431,390 A | * | 2/1984 | Hart | 418/85 |
| 5,318,151 A | * | 6/1994 | Hood et al. | 418/85 |

FOREIGN PATENT DOCUMENTS

| | | | | |
|---|---|---|---|---|
| DE | 3601816 | | 7/1987 | |
| DE | 9105021 | | 1/1991 | |
| EP | 0067949 | | 12/1982 | |
| EP | 0277582 | * | 8/1988 | 418/85 |

* cited by examiner

*Primary Examiner*—John J. Vrablik
(74) *Attorney, Agent, or Firm*—Sidley Austin Brown & Wood, LLP

(57) ABSTRACT

The invention comprises an arrangement for controlling the flow of a coolant fluid in a compressor, in particular in a rotary compressor, in which a coolant-fluid inlet for coolant fluid discharged from the compressor and a coolant-fluid outlet for returning the coolant fluid into the compressor are provided. A fluid cooler is also provided through which, when necessary, part of the coolant fluid can be directed for cooling and a system-control actuator is used to control the magnitude of the proportion of the coolant fluid that is directed through the fluid cooler on the basis of system parameters, in particular on the basis of the temperature of the coolant fluid. In the invention a summer-/winter-operation actuator is provided, which can take priority over the system-control actuator so that in a summer position it completely or partially eliminates the action of the system-control actuator, in such a way that when the summer-/winter-operation actuator is activated, the proportion of the coolant flow that is directed through the fluid cooler is increased or reduced by a fluid-control device.

18 Claims, 4 Drawing Sheets

ARRANGEMENT FOR CONTROLLING THE FLOW OF A COOLANT FLUID IN A COMPRESSOR

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates to a method and an arrangement for controlling the flow of a coolant fluid in a compressor, in particular in a rotary compressor.

BACKGROUND OF THE INVENTION

The compressors of interest here, in particular rotary compressors, are specifically screw-type compressors with fluid injection. Because such machines are frequently employed at a number of different sites, they are ordinarily movable or at least transportable. From these machines the compressed process fluid is sent through conduits to attached process-fluid consuming apparatus, for example compressed-air tools such as pneumatic hammers, pneumatic impact screwdrivers, pneumatic grinders etc.

Such compressors, for instance oil-injection screw compressors, have been known for many years. During the compression process a coolant fluid, in particular oil, is injected into the compression space to become mixed with the process fluid in these compressors. The coolant fluid serves to cool the process fluid by conducting the heat of compression away into a separate cooling circuit, and in addition acts to lubricate particular components of the compressor as well as to seal off the compression space. If the process fluid is air, it is usually sucked in from the surroundings and therefore usually contains an amount of water vapor that depends on its temperature.

A first problem, which in this case becomes apparent during the injection or recycling of the coolant fluid, lies in the risk that the temperature will fall below the condensation point for the water vapor present in the air used as process fluid. Water that has condensed out can to a certain extent become emulsified with the coolant fluid, in particular the oil, or can even be injected or recycled as an extra phase. This presents the following disadvantages, among others: reduction of the lubricant properties of the coolant fluid, increased corrosion of the components, and greater wear and tear of the bearings in the compressor.

A second problem, which should be distinguished from the first, arises when the process fluid, in particular the compressed air in the conduit leading to the pneumatic apparatus, cools off so that water contained in the process fluid condenses out. As a result, corrosion can occur in the pneumatic apparatus, with permanent damage as a potential consequence. The problem is exacerbated when within the conduits to the pneumatic apparatus, or in the apparatus itself, ice formation occurs because of the low ambient temperature and the conduits to or within the pneumatic apparatus are thereby partially or completely blocked. These effects can be made still worse by expansion of the compressed air in the apparatus, which can lead to functional inadequacies or even total failure of the associated pneumatic apparatus to operate.

A third, additional problem is created when the temperature regulation conventionally provided for the coolant fluid is designed to prevent only the first two problems, so that a process fluid at high temperatures is delivered to the pneumatic consuming apparatus. When the ambient temperature is high, only a slight degree of cooling occurs on the way to the pneumatic consuming apparatus, which can cause thermally induced injury to the operator of the apparatus.

Many preliminary considerations are known regarding ways to control the coolant fluid in compressors against the background of the problems cited above. A technical regulation principle in current use for controlling the temperature of a coolant fluid in compressors is disclosed, for example, in patent EP 0 067 949 B1. Here a thermostatic slide valve determines whether coolant fluid is sent through a fluid cooler to be used for cooling, or is shunted past the cooler in order to raise the temperature. With this form of regulation the temperature of the coolant fluid is kept relatively constant, and is set at a level such that on one hand it does not cause the temperature of the process fluid to fall below the condensation point, while on the other hand a temperature so high as potentially to damage the coolant fluid is avoided.

In U.S. Pat. No. 4,289,461 a further developed valve unit with an inlet and an outlet for coolant fluid is described. Here again, the volume flow of the coolant fluid in a bypass conduit that bridges the fluid cooler is regulated, such that a portion of the flow of coolant fluid is always passed through the fluid cooler. The regulation is achieved by means of a valve comprising two control units that act in opposite directions, one control unit operating dependent on the inlet temperature and the second one, dependent on the system temperature. One of the disadvantages of this design is that the control valve is complicated in structure and subject to malfunction, and furthermore a certain minimal volume flow of coolant fluid passes through the fluid cooler. Hence this proportion of the coolant fluid is constantly cooled, which thus also lowers the temperature of the process fluid.

U.S. Pat. No. 4,431,390 discloses a form of regulation in which a second bypass conduit is also provided as a shunt around the fluid cooler. In this second bypass conduit there is an additional valve which, when activated by a processor, allows a specific amount of coolant fluid to bypass the cooler in the form of a pulse. The release of these pulses by the processor depends on various parameters. Hence this solution is extremely elaborate to implement, both because multiple parameters must be monitored and evaluated and because an additional bypass conduit must be provided.

The solutions discussed above are predominantly concerned with the problem of keeping the coolant fluid in the compressor itself at a temperature such that water does not condense out and hence impairment of the coolant fluid and of the compressor is prevented. At the same time, the forms of regulation here disclosed are designed so as also to avoid raising the coolant fluid to a temperature high enough to be potentially damaging. However, the problems associated with the condensation of water while it is in the pneumatic consumer devices or in the conduits leading thereto are not addressed.

A variant of a solution relevant to this point is known from the patent DE 36 01 816 A1. There the compressed process fluid, which has been heated to about 60° C. above the intake temperature of the compressor, is passed through an over-dimensioned after cooler to bring it down to a temperature about 10° C. above the intake temperature. A considerable proportion of the water vapor present in the process fluid is thereby caused to condense out and is eliminated by a condensate trap. The compressed process fluid is subsequently sent to a heat exchanger where it is rewarmed so that ultimately—influenced to some degree by the current ambient parameters, which in this design are assumed to be unchanging—a process fluid is produced that is quite dry and about 60° C. above the intake temperature, i.e. very hot.

BRIEF SUMMARY OF THE INVENTION

It is an object of the present invention to provide an arrangement for controlling the coolant fluid in a conventional compressor which has a simple, economical and reliable construction and wherein it is possible to reduce or, where possible, avoid the condensation of water out of both a coolant fluid and a process fluid output by the compressor to another apparatus, in particular with respect to condensation and freezing events in the receiving apparatus itself, while a high degree of operating facility is maintained.

According to a first aspect of the present invention there is provided an arrangement for controlling the flow of a coolant fluid through a compressor comprising: a coolant-fluid inlet for coolant fluid discharged from the compressor and a coolant-fluid outlet for returning the coolant fluid to the compressor; a fluid cooler through which at least a proportion of the coolant fluid can be passed for cooling, when necessary; a system-control actuator which controls the magnitude of the proportion of the coolant fluid that passes through the fluid cooler on the basis of system parameters including the temperature of the coolant fluid by fluid-control means; a fluid-control device; and a summer-/winter-operation actuator, which in a summer position takes priority over the system-control actuator so as to limit the action of the system-control actuator in one direction, such that when the summer-/winter-operation actuator is activated, the proportion of the coolant fluid that is passed through the fluid cooler is increased or diminished by the fluid-control device.

The present invention therefore provides a summer-/winter-operation actuator which, taking priority over the system-control actuator, in a summer position completely or partially overrides the action of the system-control actuator in a direction such that when the summer-/winter-operation actuator is activated, the proportion of the coolant fluid flow that is sent through the fluid cooler is appropriately increased or reduced by a fluid-control means.

The invention achieves its object by making use of the fact that the temperature of the process fluid at the point where it emerges from the installation is determined by the temperature of the coolant fluid, and in particular corresponds approximately to the maximal temperature of the coolant fluid. Control of the temperature of the process fluid at the installation output can therefore be accomplished by influencing both the injection temperature and the injection amount of the coolant fluid.

To avoid undesired condensation of moisture in the compressor, but especially in the conduits leading to apparatus receiving the compressed process fluid from the compressor and/or within the apparatus themselves, the arrangement can initially be adjusted so that the process fluid is less strongly cooled and is sent to the consuming apparatus or into the conduits leading thereto at a comparatively high temperature. The cooling that occurs within the conduits, or by the time the fluid reaches the consuming apparatus, then usually suffices to ensure the comfort of the personnel responsible for operating the consuming apparatus. Only when the ambient temperature is high, so that the cooling effect on the process fluid as it is conducted to the consuming apparatus is in some circumstances no longer as great, does the invention provide for further cooling of the process fluid under the influence of a summer-/winter-operation actuator.

The summer-/winter-operation actuator or, more generally speaking, an ambient-temperature-compensation actuator, is provided in order to compensate as far as possible a reduction or enhancement of cooling brought about by a higher or lower ambient temperature. The terms "summer" and "winter" in the context of summer-/winter-operation actuator or summer/winter position are used herein and in the claims in order to facilitate understanding, and in general designate two different kinds of ambient conditions, namely warmer surroundings on one hand and colder surroundings on the other hand.

Hence the winter operation is intended to prevent the temperature from falling below the condensation point of the process fluid on its way to the consuming apparatus, whereas the summer operation is intended to avoid exceeding a maximal temperature at the apparatus.

With the arrangement described here it is possible by simple means to solve, in a reliable and economical manner, problems of all three kinds present in the state of the art, namely condensation in the compressor, condensation in the conduits leading to the consuming apparatus or in the apparatus themselves, and excessive heating of the consuming apparatus devices just when the ambient temperature is high.

In an alternative embodiment the summer-/winter-operation actuator, which in more general terms can be called an ambient-temperature-compensation actuator for compensating effects on the cooling of fluid associated with a higher or lower temperature of the ambient air, comprises a manual control apparatus by means of which the summer-/winter-operation actuator can be adjusted, in particular can be switched between two positions, namely a summer position and a winter position. Obviously the manual control apparatus can be constructed in various ways; for example, it can comprise a hand-operated lever, a setting wheel, where appropriate with a stepping-down action, and/or another suitable control device.

In one specific embodiment the summer-/winter-operation actuator comprises an actuating shaft with a cam structure such that the cam structure acts on the fluid-control device by way of a control element. In this case the actuating shaft can, for instance, cooperate with the manual control device or also be driven by an electric motor or by pneumatic or hydraulic means.

In another alternative embodiment the summer-/winter-operation actuator is functionally connected to a thermocouple in contact with the outside air, so that the outside-air thermocouple activates the summer-/winter-operation actuator in dependence on the external or ambient temperature.

In yet another alternative embodiment the summer-/winter-operation actuator is functionally connected to a thermosensor that activates the summer-/winter-operation actuator in dependence on the outside temperature. In both of the preceding embodiments the advantage over a manual control apparatus is that there is automatic compensation of an elevated or reduced cooling effect when the ambient air is colder or warmer, whereas with a manual control apparatus the activation of the summer-/winter-operation actuator has to be performed by the operating personnel.

In an especially preferred embodiment the system-control actuator and the summer-/winter-operation actuator are functionally connected to a common fluid-control device that adjusts the proportion of the coolant-fluid flow that is directed through the fluid cooler, such that the functional connection between the system-control actuator and the fluid-control device is completely or partially interrupted in one direction of action when the summer-/winter-operation actuator is adjusted in the direction towards a summer position. In this way, when both the system-control actuator and the summer-/winter-operation actuator influence the flow of the coolant fluid by way of only one common fluid-control device, control of the cooling of the process fluid can be especially simply and effectively accomplished. At the same time the actuator prioritization, which is regarded as a useful feature, is implemented in a particularly simple manner, inasmuch as when it is needed, the summer-/winter-operation actuator can be put into a position in which it completely or partly eliminates the action of the fluid-control device in one direction. This makes it possible to set the installation initially to a relatively high temperature of the process fluid, as described at the outset, and then, when the ambient temperature is high, to make corrections by means of the summer-/winter-operation actuator.

In one embodiment of the invention the system-control actuator and summer-/winter-operation actuator are disposed coaxially, which enables a relatively simple construction.

In another preferred embodiment a displaceably mounted control element is made integral with the fluid-control device, as a control cylinder. Here the displaceably mounted control element is a force- or action-transmitting means, which need not necessarily be immersed in the fluid flow. Preferably also, the one-piece cylinder extends into the fluid flow and simultaneously comprises sealing surfaces, to seal off the fluid channel.

In a structurally preferred embodiment the system-control actuator is attached to and preferably within the control element and is braced against a contact surface that is fixed in a given position regardless of the position of the summer-/winter-operation actuator. Thus depending on the position of the summer-/winter-operation actuator, the system-control actuator is only partially effective or in some circumstances entirely ineffective in one direction of action with respect to adjustment of the fluid-control device.

In one concrete, advantageous embodiment the summer-/winter-operation actuator acts on the control element by way of a displacement piston, directly or indirectly, to adjust the fluid-control device.

The summer-/winter-operation actuator can be switched between at least two positions. Preferably it can also occupy one or more intermediate positions or, as is especially preferred with respect to control technology, can be shifted continuously between a first (winter) position and a second (summer) position.

Furthermore, it is also possible to apply a logical reversal of the idea underlying the present invention, namely to use the arrangement for controlling the flow of coolant fluid so as to keep the process fluid in a compressor initially at a relatively low temperature, at which it is subject to condensation, and at critical, in this case cool ambient temperatures to give the summer-/winter-operation actuator or compensation actuator priority for influencing the flow of coolant fluid so as to raise the temperature of the process fluid. Moreover, with the concept of prioritization according to the present invention, the temperature of the process fluid can be influenced not only by controlling the temperature of the coolant fluid injected into the compressor but also, additionally or alternatively, by altering the volume flow of the coolant fluid.

Preferably also, the fluid-control device is positioned at a junction between a bypass conduit that bridges the fluid cooler and a cooling conduit associated with the fluid cooler, in such a way that when the flow of coolant fluid through the fluid cooler is increased, the amount of coolant fluid flowing through the bypass conduit is simultaneously reduced. In this case the junction at which the fluid-control device is positioned can be situated either ahead of the fluid cooler in the direction of flow or after the fluid cooler. Positioning of the fluid-control device at a junction is regarded as particularly advantageous because as the one flow component is increased, a simultaneous reduction of the other component is brought about, so that the influence of this action is extremely effective.

According to a third aspect of the present invention there is provided a method of controlling the flow of a coolant fluid through a compressor, in particular through a rotary compressor, in order to adjust the temperature of a process fluid wherein the coolant fluid discharged from the compressor can be directed through a fluid cooler when necessary for cooling, the proportion of coolant fluid injected into the compressor or the proportion of the coolant fluid that is directed through the fluid cooler being controlled on the basis of system parameters including the temperature of the coolant fluid, and wherein, in order to prevent condensation or ice formation in apparatus receiving the output from the compressor or in conduits connecting the compressor to such apparatus when the temperature of the outside air is low, in particular when the temperature of the outside air falls below a certain threshold $T_G$, the proportion of coolant fluid injected into the compressor is decreased or the magnitude of the proportion of the coolant fluid directed through the fluid cooler is reduced or is interrupted.

In a preferred embodiment of this method, the coolant flow directed through the fluid cooler is initially reduced irrespective of the outside-air temperature and is only increased when the outside air becomes warm, in particular when its temperature rises above the threshold $T_G$.

The present invention will now be described by way of example with reference to the attached drawings.

DETAILED DESCRIPTION OF THE INVENTION

Figure 1:
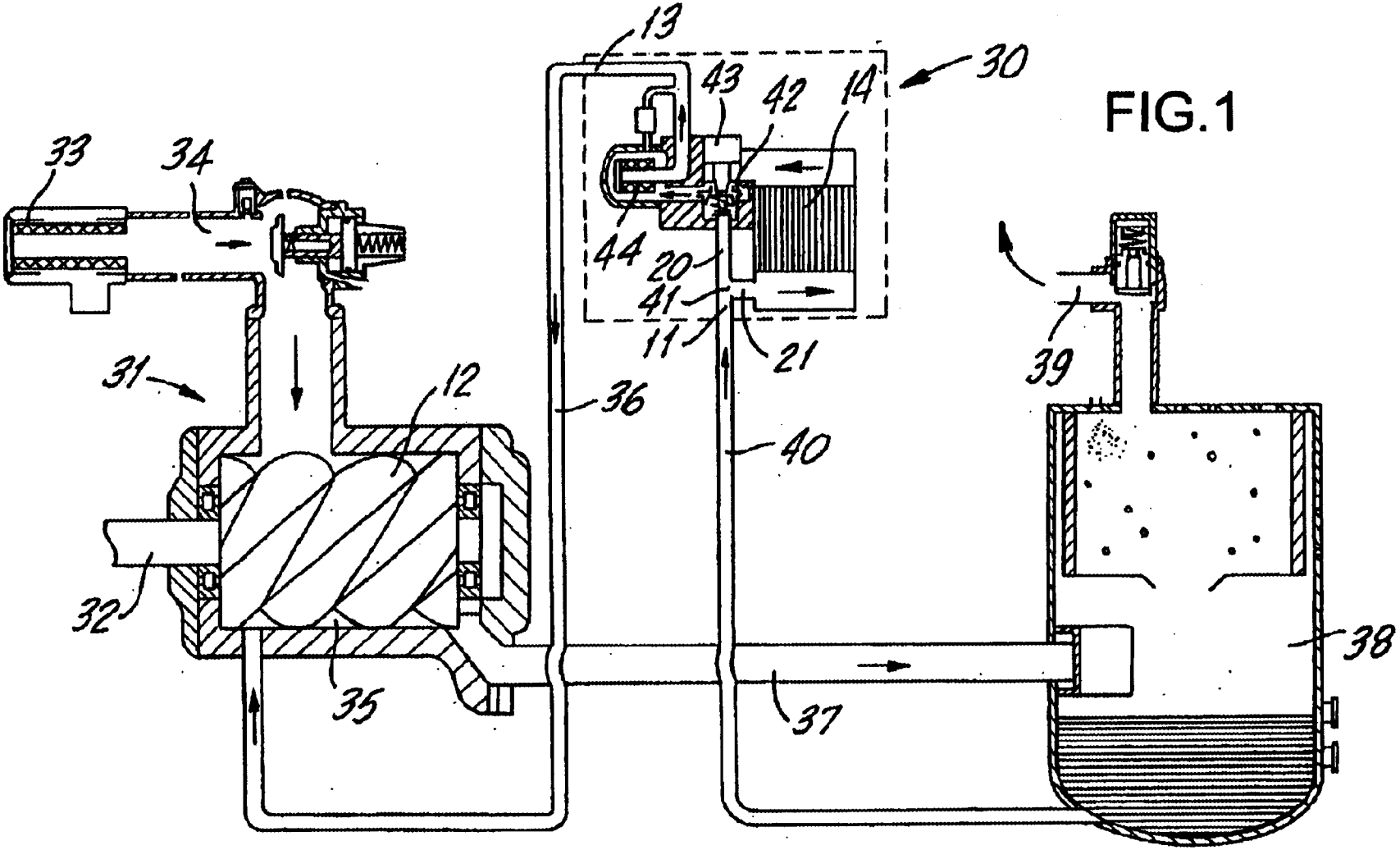
FIG. 1 is a schematic view in partial cross-section of an embodiment of a rotary compressor fluid cooling system, which comprises an arrangement for controlling the flow of coolant fluid in accordance with the present invention.

In FIG. 1 a compressor installation 31 with a compressor 12 and, attached thereto, an arrangement 30 for controlling the flow of coolant fluid are represented schematically. The compressor 12 is driven by a driving mechanism (not shown) by way of a drive shaft 32. Ambient air is sucked into the compressor 12 by way of an intake filter 33 and passes through an intake fitting 34 into the compression space 35. At the same time, by way of a supply pipe 36 a coolant fluid, which in the present case is oil, is supplied to the compressor. Coolant fluid in the form of oil serves for lubrication, improves sealing and cools the sucked-in and compressed process fluid, which here takes the form of compressed air. The mixture of compressed air and oil is sent through a coolant-fluid/process-fluid conduit 37 to a fluid separator 38. In the fluid separator 38 the coolant-fluid/process-fluid mixture, here an oil/compressed-air mixture, is separated. The process fluid obtained in the form of compressed air is sent to an outlet conduit 39 and from there passes through consumer conduits (not shown) to one or more consumer devices.

The coolant fluid reclaimed in the fluid separator 38 in the form of oil flows through a return pipe 40 to a first junction 41, where a cooler conduit 21 branches off to a fluid cooler 14 from which the fluid passes to a second junction 42. A bypass conduit 20 connects the first junction 14 directly to the second junction 42, bridging the fluid cooler 14.

The second junction 42 in the present embodiment is defined by a valve unit 43. The valve unit 43 can preferably be mounted directly on the compressor block or on the fluid separator 38, or it can also be attached to the fluid cooler 14. The valve unit 43 comprises a system-control actuator 15, which is in functional connection with a fluid-thermocouple 29 and controls a fluid-control device 19 on the basis of the temperature of the coolant fluid (cf. FIG. 2). When the temperature of the coolant fluid rises, the fluid-control device reduces the proportion of the fluid that flows through the bypass conduit and simultaneously increases the proportion that flows through the cooler 14, so that the temperature of the coolant fluid as a whole is more strongly reduced by the fluid cooler 14. Conversely, if the coolant fluid becomes colder, the fluid-control device causes less coolant fluid to flow through the fluid cooler; at the same time, the proportion of fluid that bypasses the cooler 14, through the conduit 20, is increased; the net result is that the fluid as a whole is cooled to a lesser extent.

As shown here, the coolant fluid can then be sent through an oil filter 44 and is returned to the compression space 35 of the compressor 12 by way of the above-mentioned supply lead 36. The arrangement in accordance with the invention for controlling the flow of coolant fluid is integrated into a circulation path that runs through the compression space 35 of the compressor 12 and the fluid separator 38. A coolant-fluid inlet 11 of the arrangement 30 for controlling the flow of coolant fluid is here defined by the above-mentioned return conduit 40, and a coolant-fluid outlet 13 is defined by the likewise above-mentioned supply conduit 36.

Figure 2:
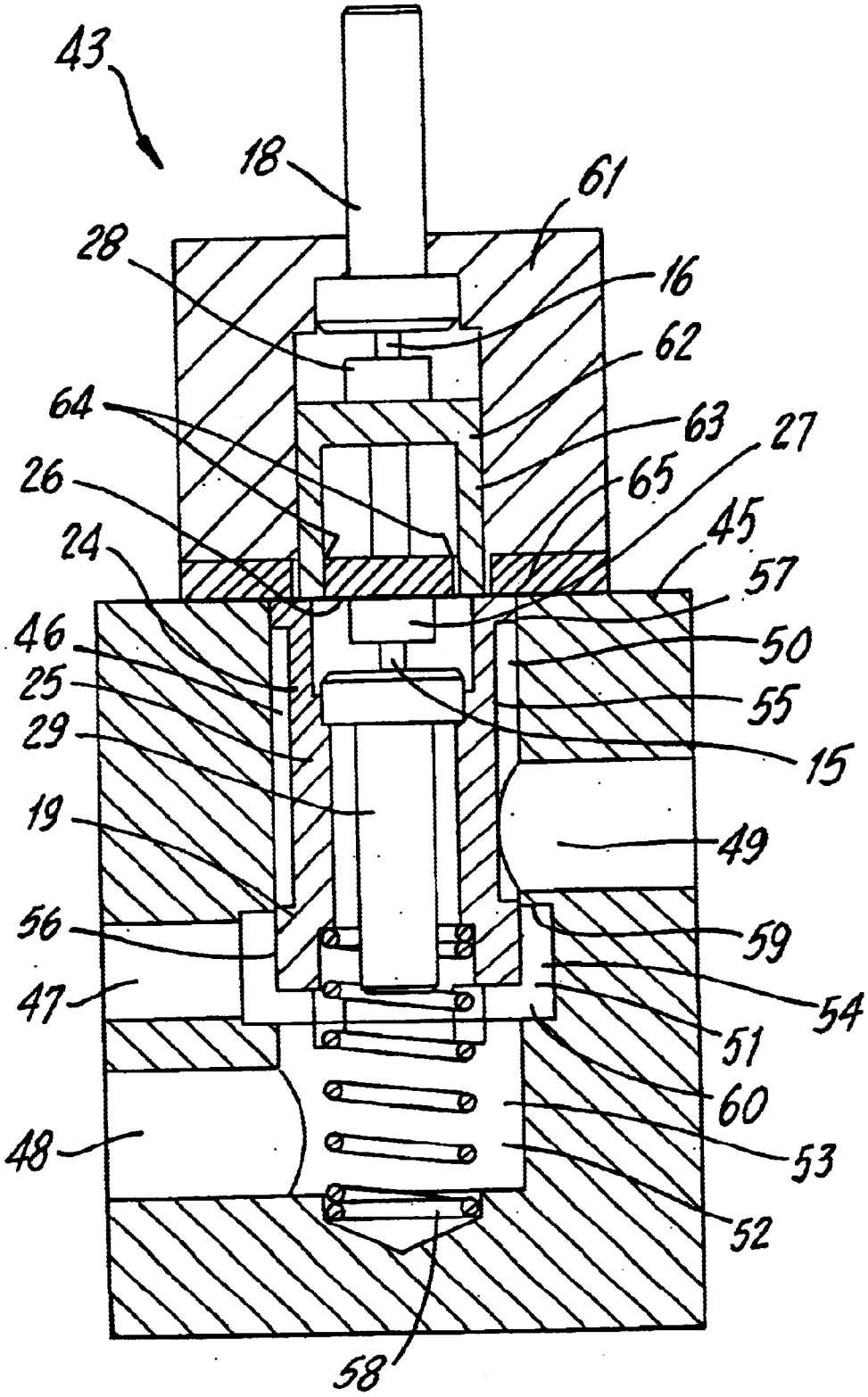
FIG. 2 is a cross-section of a valve unit forming a part of the arrangement for controlling the flow of coolant fluid in compressors as shown in FIG. 1.

In FIG. 2 a first embodiment of the valve unit 43, indicated only schematically in FIG. 1, is illustrated as a sectional view of a specific construction. The valve unit 43 first comprises a valve block 45 with a central bore 46, a first side bore 47, a second side bore 48 and a third side bore 49. The central bore 46 consists of an upper section 50, a middle section 51 and a lower section 52. The lower section 52 defines a central interior space 53 of the valve. The middle section is wider than the lower section 52 and upper section 50 and forms a valve chamber 54. By way of the first side bore 47 the valve chamber 54 is in fluid communication with the supply conduit 36, which leads to the compression space 35 of the compressor 12. The central interior space 53 of the valve is in fluid communication with the bypass conduit 20, by way of the second side bore 48. The upper section 50 of the central bore 46 in the valve block 45 defines an upper interior space 55 of the valve, which is in fluid communication with the fluid cooler 14 by way of the third side bore 49.

In the central bore 46 of the valve block 45 is disposed a control cylinder 25, which here integrates a control element 24 and a fluid-control device 19 as mentioned above, and which is seated so that it can be longitudinally displaced. The fluid-control device constituting its lower end is provided in order either to block passage of one of the two flow components flowing through the fluid cooler 14 or the bypass conduit 20, or to maintain a particular ratio of these two components. For this purpose, the part of the control cylinder 25 that serves as fluid-control device 19 comprises a first circumferential sealing surface 56. In addition, the control cylinder comprises at its opposite, upper end a second circumferential sealing surface 57. The circumferential sealing surfaces 56 and 57 are so constructed and dimensioned that they form a fluid-tight seal against the wall of the central bore 46. In so doing, the second circumferential sealing surface 57 prevents the emergence of oil. In contrast, the action of the first circumferential sealing surface 56 is to block the flow of one of the fluid-flow components completely, apart from a leakage flow; depending on whether the control cylinder 25 is in a first or second end position, it blocks the flow either through the fluid cooler 14 or through the bypass conduit.

The control cylinder 25 is moved between the said end positions, or into intermediate positions, as follows. Initially the control cylinder 25 is placed under pretension, by a helical spring 58 disposed in the central interior space 53 of the valve, so that the cylinder is pressed into an upper position in which it blocks the flow component that is directed through the fluid cooler 14. Displacement of the control cylinder 25 out of this end position can be accomplished either by a system-control actuator 15 or by a summer-/winter-operation actuator 16.

Within the control cylinder 25 the above-mentioned fluid-thermocouple 29 is mounted the system-control actuator 15, which is activated by the fluid-thermocouple. When the fluid-thermocouple 29 is heated, a substance contained therein expands and pushes the system-control actuator 15 out of the fluid-thermocouple 29. By way of a displacement piston 27 the system-control actuator 15 is braced against a bearing surface 26 that is fixed in position relative to the valve block 45, so that expansion of the substance within the fluid-thermocouple 29 causes the control cylinder 25 as a whole to move towards the central interior space 53, against the pressure exerted by the helical spring 58, thus opening an upper annular gap 59 between the upper interior space 55 of the valve and the valve chamber 54. As a consequence of the formation of the annular gap, coolant fluid can now flow from the fluid cooler 14 into the valve chamber 54, and after mixing with coolant fluid from the bypass conduit 20 it is sent through the supply conduit 36 into the compression space 35 of the compressor 12. If the control cylinder 25 moves further towards the central interior space 53 of the valve, the upper annular gap 59 expands, and at the same time a corresponding lower annular gap 60 between the valve chamber corresponding lower annular gap 60 between the valve chamber 54 and the central interior space 53 becomes continually smaller. The consequence is that a progressively greater flow component from the fluid cooler 14, and simultaneously a progressively smaller fluid component from the bypass conduit 20, can enter the valve chamber 54. If the control cylinder 25 shifts still further towards the central interior space 53, the first circumferential sealing surface 56 closes the lower annular gap 60, at which point the first circumferential sealing surface 56 once again contacts the wall of the central bore 46 so as to form a seal.

Displacement of the control cylinder 25 can also be independent of the system-control actuator 15, under the control of the above-mentioned summer-/winter-operation actuator 16 as follows. An outside-air thermocouple 18 is disposed in a valve lid 61 so as to be coaxial with the system-control actuator 15, and the summer-/winter-operation actuator 16 is movably mounted within the outside-air thermocouple 18 so that it extends towards the system-control actuator 15, pointing to the valve chamber 54. The outside-air thermocouple likewise contains a substance that expands when the temperature rises, and during expansion it pushes the summer-/winter-operation actuator 16 outward. The outside-air thermocouple 18 is either in direct contact with the ambient air or its temperature is adjusted so as to be approximately representative of the ambient air temperature. Within the valve lid 61, coaxial with the summer-/winter-operation actuator 16 and the system-control actuator 15, a control-crown 62 is also movably seated. The control crown 62 preferably comprises several projecting struts 63, which pass through associated apertures 64 in a cover plate 65 that covers the central bore 46 of the valve block 45. By way of the cover plate 65, the valve lid 61 is connected to the valve block 45.

When the control cylinder 25 is in the position shown in FIG. 2, the distal ends of the struts 63 are opposed to the control cylinder 25. The summer-/winter-operation actuator 16 is seated against the control crown 62 on the other side, by way of a displacement piston 28. Warming of the substance contained within the outside-air thermocouple 18 causes the summer-/winter-operation actuator 16 to be pushed out of the outside-air thermocouple towards the valve chamber 54, so that it in turn presses against the control cylinder 25 by way of the control crown 62. As a result, the fluid-control device 19, which forms an integral part of the control cylinder 25, opens the upper annular gap 49 while simultaneously reducing the size of the lower annular gap 60. The consequence is that more coolant fluid flows through the fluid cooler 14, and at the same time the flow component sent through the bypass conduit 20 is diminished. If even higher temperatures cause the substance contained in the outside-air thermocouple 18 to expand still further, by way of the summer-/winter-operation actuator 16 the control crown 62 and hence the control cylinder 25 are pushed further down, i.e. towards the central interior space 53 of the valve, and can ultimately reach an end position in which the lower annular gap 60 is closed, so that no flow component at all is then sent through the bypass conduit 20. In this position, the influence of the system-control actuator 15 is entirely eliminated.

In intermediate positions the summer-/winter-operation actuator 16 merely establishes a minimal position for the width of the upper annular gap 59, and hence for the magnitude of the flow component sent through the fluid cooler 14. If the coolant fluid should become so warm that the system-control actuator 15 is pressed out of the fluid-thermocouple 29 far enough to exert a force on the bearing surface 26, the control cylinder 25 would move further in the direction of the central interior space 53 and thus further expand the upper annular gap 59. However, the system-control actuator 15 is not capable of making the width of the upper annular gap 59 smaller than that predetermined by the summer-/winter-operation actuator 16.

Figure 3:
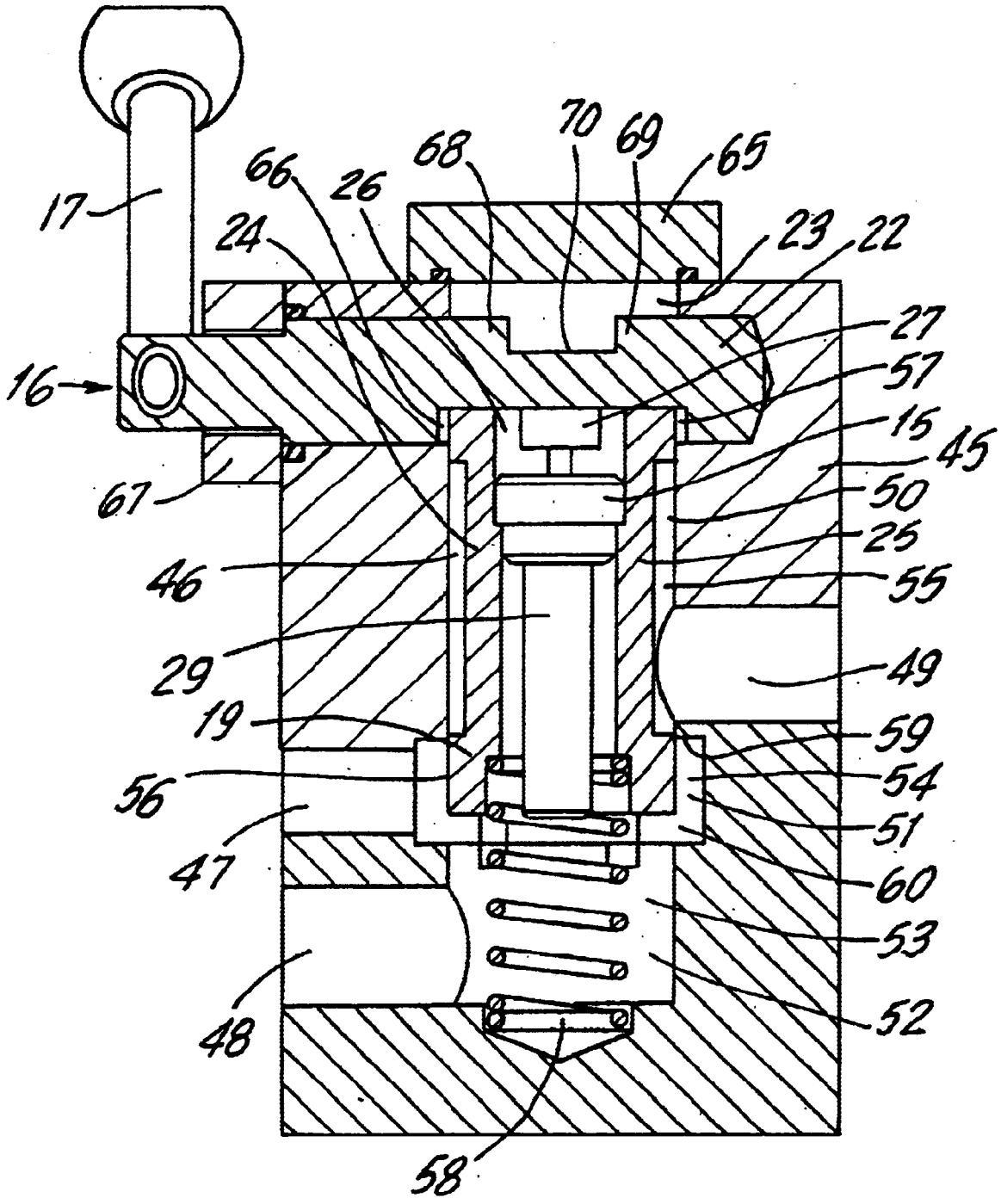
FIG. 3 is a cross-section of a second embodiment of valve unit for an arrangement for controlling the flow of coolant fluid in compressors, in a first position.

In FIG. 3 is shown an alternative embodiment of a valve unit for an arrangement for controlling the flow of coolant fluid according to the invention. The two embodiments differ from one another basically in that the summer-/winter-operation actuator 16 in the embodiment according to FIG. 3 is not impelled by an outside-air thermocouple 18 but rather comprises a manual operating device, in the present case specifically a hand lever 17, which acts on the control cylinder 25 by way of an operating shaft 22 and a cam structure 23 integral with the shaft 22 to produce an effect similar to that exerted by the struts 63 of the control crown 62—for instance, when the shaft 22 is rotated through 120°.

Specifically, the valve block 45 in the embodiment according to FIG. 3 is made somewhat longer and comprises a fourth side bore 66, which traverses the central bore 46 and defines a passageway on one side of the central bore 46 as well as a pocket bore on the opposite side. The operating shaft 22 is pushed into this fourth side bore 66 above the control cylinder 25, and is held in place there by means of a bearing disk 67. The cam structure 23 on the shaft 22 is defined by two eccentric sections 68, 69, situated on the two sides of a circumferential groove 70. The circumferential groove 70 in the embodiment shown here defines the bearing surface 26 for the displacement piston 27 of the system-control actuator 15 and is distinguished by the fact that the position of this bearing surface remains constant when the operating shaft 22 is rotated. Whereas the bearing surface 26 defined by the circumferential groove 70 remains at a constant height during rotation of the shaft 22, the eccentric sections 68, 69 displace the control cylinder 25 towards the central interior space 43 of the valve, so that the upper annular gap 59 is enlarged according to the dimensioning of the eccentricity of the eccentric sections 68, 69. In the embodiment shown here, a 120° rotation of the shaft 22 causes the lower annular gap 60 to become closed, so that the flow component directed through the bypass conduit is blocked. The action of the system-control actuator 15 is likewise eliminated in this end position.

With appropriate configuration of the eccentric sections 68, 69 and with the provision of appropriate additional engagement positions, however, the operating shaft 22 can also be used for adjustment of the cylinder to specified intermediate positions.

Figure 4:
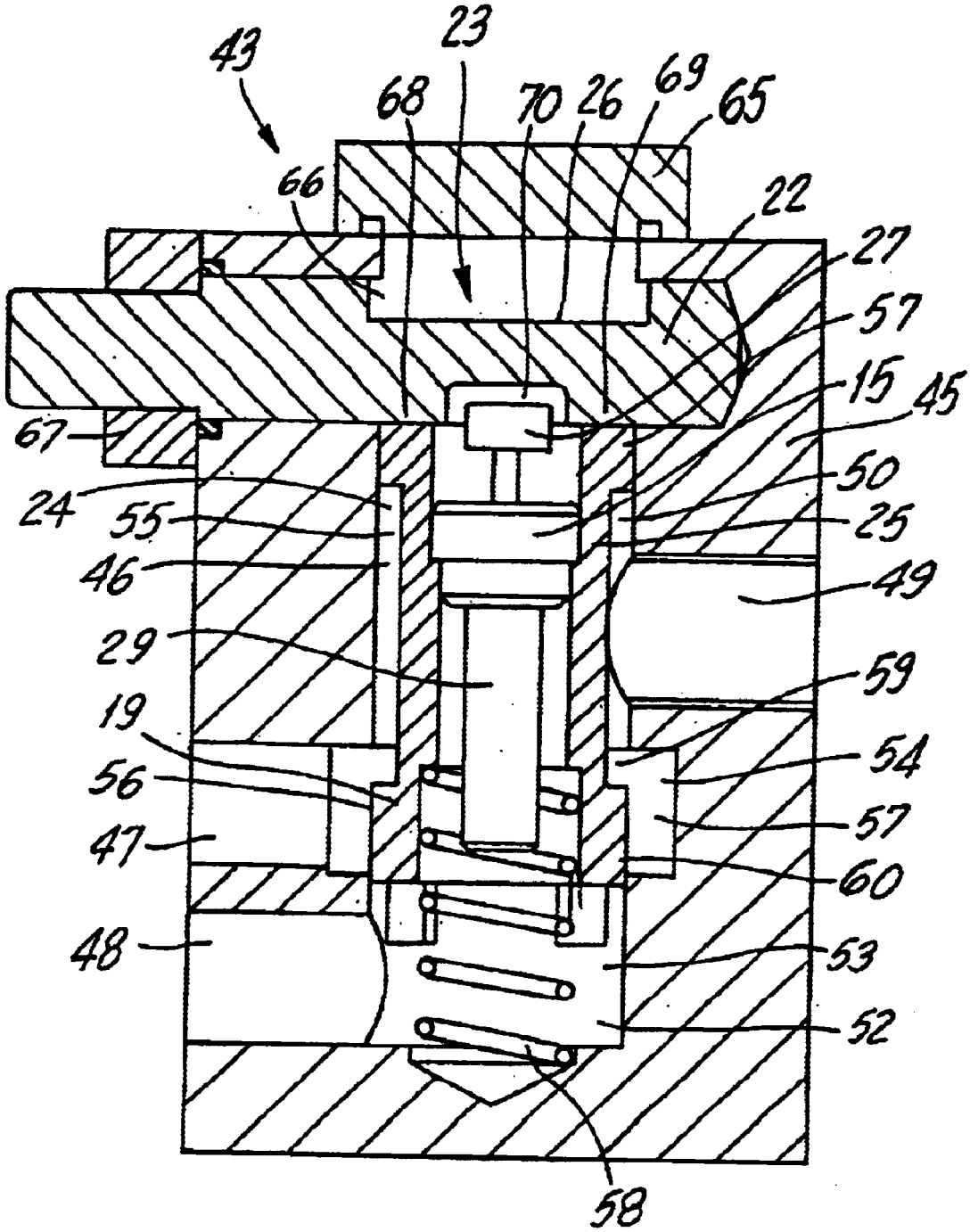
FIG. 4 is a cross-section of the valve unit shown in FIG. 4 but in a second position.

In FIG. 4 the embodiment of a valve unit according to FIG. 3 is shown in a second position, in which the hand lever 17 (not shown) has been rotated by 120°. In the position according to FIG. 4 the upper annular gap 59 is completely opened, and simultaneously the lower annular gap 60 is closed by the control element 24. The bearing surface 26 of the cam structure 23 on the shaft 22 presses the control cylinder 25 and hence the control element 24 against the helical spring 58, so that the upper annular gap 59 is opened and the lower annular gap 60 is closed. As can be seen in this drawing, the displacement piston 27 of the system-control actuator 15 no longer abuts against the contact surface 26 of the shaft 22, so that in this position the system-control actuator 15 no longer has any influence on the control element 24. In the embodiment shown here this is true even when the displacement piston 27 is completely extended from the fluid-thermocouple 29, so that the manual control has priority not only for a particular temperature regime but also regardless of the temperature of the coolant fluid. Depending on the dimensioning of the cam structure 23 with eccentric sections 68, 69 as well as that of the circumferential groove 70, however, it is also possible to implement a prioritization such that in certain regions of coolant-fluid temperature the displacement piston 27 of the system-control actuator 15 can still transmit a controlling action to the control element 24.

I claim:

1. Arrangement for controlling the flow of a coolant fluid through a compressor comprising:

a coolant-fluid inlet for coolant fluid discharged from the compressor and a coolant-fluid outlet for returning the coolant fluid to the compressor;

a fluid cooler through which at least a proportion of the coolant fluid can be passed for cooling, when necessary;

a system-control actuator which controls the magnitude of the proportion of the coolant fluid that passes through the fluid cooler on the basis of system parameters including the temperature of the coolant-fluid by fluid-control means;

a fluid-control device; and a summer-/winter-operation actuator, which in a summer position takes priority over the system-control actuator so as to limit the action of the system-control actuator in one direction, such that when the summer-/winter-operation actuator is activated, the proportion of the coolant fluid that is passed through the fluid cooler is increased or diminished by the fluid-control device.

2. Arrangement for controlling the flow of a coolant fluid in a compressor comprising:

a coolant-fluid inlet for coolant fluid discharged from the compressor and a coolant-fluid outlet for returning the coolant fluid to the compressor;

a fluid cooler through which a proportion of the coolant fluid can be diverted to be cooled;

a system-control actuator which controls the proportion of coolant fluid that is injected into the compressor on the basis of system parameters including the temperature of the coolant fluid, by fluid-control means;

a fluid control device; and a summer-/winter-operation actuator, which in a summer position takes priority over the system-control actuator to limit the action of the system-control actuator in one direction such that when the summer-/winter-operation actuator is activated, the proportion of coolant fluid that is injected into the compressor is increased or is diminished by the fluid-control device.

3. Arrangement as claimed in claim 1 or claim 2, wherein the summer-/winter-operation actuator comprises a manual operating device by means of which the summer-/winter-operation actuator operationally switched between two positions.

4. Arrangement as claimed in claim 1 or claim 2, wherein the summer-/winter-operation actuator comprises an operating shaft with a cam means that acts on the fluid-control means by way of a control element.

5. Arrangement as claimed in claim 1 or claim 2, comprising an outside-air thermocouple with which the summer-/winter-operation actuator is in functional communication and which activates the summer-/winter-operation actuator dependent on the outside temperature.

6. Arrangement as claimed in claim 1 or claim 2, comprising a thermosensor with which the summer-/winter-operation actuator is in functional communication and which activates the summer-/winter-operation actuator dependent on the outside temperature.

7. Arrangement as claimed in claim 1 or claim 2, comprising a fluid-thermocouple with which the system-control actuator is in functional communication and which activates the system-control actuator dependent on the temperature of the coolant fluid.

8. Arrangement as claimed in claim 1 or claim 2, comprising a thermosensor with which the system-control actuator is in functional communication and which controls the system-control actuator dependent on at least one system parameter including the temperature of the coolant fluid.

9. Arrangement as claimed in claim 1 or claim 2, wherein the system-control actuator and the summer-/winter-operation actuator are in functional communication with the fluid-control device, which comprises the fluid-control means that controls the proportion of coolant fluid passing through the fluid cooler, and wherein the functional connection between the system-control actuator and the fluid-control means is at least partially eliminated when the summer-/winter-operation actuator is operated so as to shift it in the direction of a summer position.

10. Arrangement as claimed in claim 1 or claim 2, wherein the system-control actuator and the summer-/winter-operation actuator are disposed coaxially with one another.

11. Arrangement as claimed in claim 1 or claim 2, wherein the system-control actuator and the summer-/winter-operation actuator are disposed relative to one another such that control forces that they exert are oriented in a common direction of action.

12. Arrangement as claimed in claim 1 or claim 2, wherein the system-control actuator is disposed between the summer-/winter-operation actuator and the fluid-control means.

13. Arrangement as claimed in claim 1 or claim 2, comprising a movably mounted control element which is constructed integrally with the fluid-control device as a control cylinder.

14. Arrangement as claimed in claim 13, wherein the system-control actuator is attached to the control element and is braced by means of a displacement piston against a bearing surface that is fixed in place regardless of which of the positions provided therefor is occupied by the summer-/winter-operation actuator.

15. Arrangement as claimed in claim 14, wherein the system-control actuator with the displacement piston acts directly or indirectly on a control element in order to change the position of the fluid-control device.

16. Arrangement as claimed in claim 1 or claim 2, wherein the fluid-control device is disposed at a junction between a bypass conduit that bypasses the fluid cooler and a cooler conduit associated with the fluid cooler, such that when the flow of coolant fluid directed through the fluid cooler is increased, the flow of coolant fluid through the bypass conduit is simultaneously decreased.

17. Arrangement as claimed in claim 16, wherein the fluid-control device can be continuously shifted between a first end position that substantially blocks the bypass conduit and a second end position that substantially blocks the cooler conduit.

18. A method of controlling flow of a coolant fluid through a compressor for adjusting a temperature of a process fluid, comprising the steps of directing the coolant fluid discharged from the compressor, when necessary for cooling, through a fluid cooler for cooling the coolant fluid; and controlling at least one of an amount of coolant fluid injected into the compressor and a proportion of the coolant fluid directed through the fluid cooler on basis of system parameters including a temperature of the coolant fluid, wherein a reduction of the temperature of the process fluid is effected by at least one of increasing an amount of coolant fluid injected into the compressor and increasing of a proportion of the coolant fluid directed through the fluid cooler, wherein an increase of the temperature of the process fluid is effected by at least one of reducing an amount of coolant fluid injected into the compressor and reducing of a proportion of the coolant fluid directed through fluid cooler, wherein a winter operation is conducted at low atmospheric temperatures, and a summer operation is conducted at high atmospheric temperatures, wherein in order to prevent a maximal temperature of the process fluid in a consuming apparatus from exceeding a predetermined threshold at the high atmospheric temperatures and to prevent condensation or ice formation in the consuming apparatus and conduits connecting the consuming apparatus with the compressor at the low atmospheric temperatures, during the summer operation, lower temperatures of process fluid are controlled as during the winter operation; and wherein a change-over between the winter and summer operations is effected one of manually and automatically by a summer/winter operation actuator that functions dependent on an atmospheric temperature.

* * * * *